US007100342B2

(12) United States Patent
Holloway

(10) Patent No.: US 7,100,342 B2
(45) Date of Patent: Sep. 5, 2006

(54) BUILDING PANEL

(76) Inventor: Wynn Peter Holloway, Thurlstone House, Backside Lane, Sibford Gower, Banbury, Oxfordshire OX15 5RS (GB)

( * ) Notice: Subject to any disclaimer, the term of this patent is extended or adjusted under 35 U.S.C. 154(b) by 366 days.

(21) Appl. No.: 10/621,477

(22) Filed: Jul. 17, 2003

(65) Prior Publication Data

US 2005/0072097 A1 Apr. 7, 2005

(30) Foreign Application Priority Data

Jul. 18, 2002 (GB) ..... 0216699.9

(51) Int. Cl.
*E04C 2/00* (2006.01)
*E04C 2/54* (2006.01)

(52) U.S. Cl. ..... 52/782.1; 52/586.1; 52/585.1; 52/481.1; 52/483.1

(58) Field of Classification Search ..... 52/782.1, 52/309.7, 309.11, 309.9, 783.1, 794.1, 309.14, 52/309.15, 309.16, 309.1, 578, 579, 580, 52/588.1, 586.1, 585.1, 589.1, 590.2, 729.1, 52/284, 479, 481.1, 282.1, 282.4–282.5, 52/729.4, 483.1
See application file for complete search history.

(56) References Cited

U.S. PATENT DOCUMENTS 4,125,984 A * 11/1978 Jonas ..... 52/794.1
4,360,553 A * 11/1982 Landheer ..... 428/45
4,402,167 A * 9/1983 Denucci ..... 52/426
4,744,185 A * 5/1988 Lamberet et al. ..... 52/309.11
5,062,250 A * 11/1991 Buzzella ..... 52/586.2
5,524,400 A * 6/1996 Schmechel ..... 52/474
5,815,989 A * 10/1998 Bennenk et al. ..... 52/80.1
5,848,508 A * 12/1998 Albrecht ..... 52/309.9
5,927,032 A * 7/1999 Record ..... 52/309.11
6,494,012 B1 * 12/2002 Seng ..... 52/731.5
6,519,904 B1 * 2/2003 Phillips ..... 52/309.12
6,604,715 B1 * 8/2003 Howe ..... 248/62
6,796,093 B1 * 9/2004 Brandes ..... 52/309.8

* cited by examiner

*Primary Examiner*—Naoko Slack
*Assistant Examiner*—Chi Q. Nguyen
(74) *Attorney, Agent, or Firm*—Paul E Milliken; Ray L Weber

(57) ABSTRACT

A modular building panel comprising a rectangular frame 11 having one face covered in a water resistant board 16 with the other face also covered in a board material 17, the frame having top and bottom rails 12, 13 joined together by wood composite "I" beams 14. Two of said I beams 14A & 14B also form the sides of the frame with their recessed sides 28 facing outwardly thereof. The recessed sides 28 of the outer I beams 14A 14B in use accommodate jointing posts for linking adjacent panels.

16 Claims, 7 Drawing Sheets

BUILDING PANEL

FIELD OF THE INVENTION

This invention relates to modular building panels used in the construction of buildings, and in particular but not exclusively, for use in the construction of an inner load bearing wall of a house.

BACKGROUND OF THE INVENTION

The present invention relates to building construction and in particular to the construction of dwellings formed from spaced apart inner and outer walls in which the inner wall provides a load bearing structure which support the upper floors and roof structure etc., and the outer wall is formed of a weather resistant material e.g brickwork, timber cladding etc. A known construction of building is the Canadian timber frame house.

One known inner wall module is pre-assembled from a laminate of plywood, foam and plasterboard. Another known construction comprises two layers of cement fibre-board having a foam layer therebetween.

The present invention seeks to provide a load bearing wall panel which is supplied in modular form and which is dimensionally stable, and is light to handle,

STATEMENTS OF INVENTION

According to the present invention there is provided a building panel comprising a rectangular frame having one face covered in a water resistant board, and the other face also covered in a board material, the frame having top and bottom rails being formed from a water resistant composite, with the two rails being joined together by a plurality of spaced apart wood composite "I" beams extending therebetween with two of said I beams forming the sides of the frame, and the space between the faces being filled with insulation.

The term "board" includes various boards derived from timber including hardboard, cardboard, plywood, plaster board etc. Preferably, the said one face in use faces externally of the building and is covered OSB (oriented strand board) or plywood. Said other face in use faces internally of the building and may comprise plywood, plasterboard, calcium board or oxidised magnesium board, or other suitable board preferably having a finished decorative surface e.g a melamine layer laminated on its internal surface, or a laminated plastic layer suitable for decoration.

Such a panel after erection of the inner wall of a building e.g. a house, is substantially weather proof.

The I beams each have upper and lower flanges formed from plywood and a web comprising a rigid foam layer sandwiched between two layers of board, preferably plywood, hardboard or cardboard.

Preferably, intermediate support columns are located one between each pair of adjacent beams, each column comprising a rigid foam centre having a layer of board on each side. In a preferred arrangement, a hollow conduit extends along the middle of the column for its full length and aligns with apertures formed in either or both the top and bottom rails. The conduit is preferably rectangular and is lined on all sides by board or plywood. In use the conduits are used accommodate wiring cable, aerial coaxial cable, pipes, plumbing etc.

The top and bottom rails preferably a "H" or "U" section providing a flat base with arms extending normally thereof with a recess therebetween. If two "u" section rails are used the top rail has its flat base presented outwardly of the panel and the bottom rail has the recess presented outwardly of the panel.

The recessed sides of said two I beams have shouldered dowels longitudinally spaced therein, the dowels in use for fixing a linking post to a panel.

The invention also provides a post for linking together two of the above panels, wherein the post has a rectangular cross-section with a plurality of keyhole apertures spaced along its length and aligning with said dowels, and an alignment means attached to the upper portion of the post for alignment of said apertures and dowels, the alignment means being removable when the post is driven into its operative position.

When constructing an internal wall for a building, in particular a load bearing wall, adjacent wall panels are linked together by linking posts having side portions which are engagable within the recessed sides of the I beams. Where a panel is fixed to an existing wall, a "U" shaped cross-sectional bracket having a similar form to a recessed side of an I beam may be secured to the existing wall and the post may be engagable between said bracket and a recessed side of an I beam in the adjacent panel. The posts may be formed with longitudinal tongues which are a slide fit within the recessed sides of the I beams between the flanges on the respective I-beams. Preferably the posts comprise a box section having plywood sidewalls and a filled central cavity. The posts may be fixed to the panels by means of shouldered dowels secured to the I-beams engaging in aligned key-hole apertures in clips secured on the posts, preferably within the posts. The clip is made of a resilient material and is inclined internally of the post so that when a dowel is engaged in a key-hole longitudinal displacement of the post will tend to pull the post and respective panel together. Each post may be formed with a lug or other mark on its upper end to both align and orientate the key-hole clips on the post with respect to the dowels on a panel.

Also according to the invention there is provided a method of constructing an internal wall of a building in which panels according to the present invention are fixed to sole plates attached to the floor or base of a building by engaging the recessed bottom rail of each panel over the sole plate and passing fasteners through the arms of the bottom rail and sole plate. The wall panels are then secured together using posts are described above.

DESCRIPTION OF THE DRAWINGS

The invention will be described by way of example and with reference to the following drawings in which.

DETAILED DESCRIPTION OF THE INVENTION

With reference to FIGS. 1 to 7, there is shown a panel 10 which in this example is a module for building the internal load bearing wall of a dwelling or other building. The panel 10 has predetermined standard dimensions for matching with and assembly to other modular panels, for example width W of 1200 mm, thickness T of 150 mm, and height H of 2400 mm. Other panels according the present invention may have differences to at least some of the above dimensions.

Such a panel may also be used for other partition walls, for forming roofing, ceiling panels or floor panels.

Figure 7:
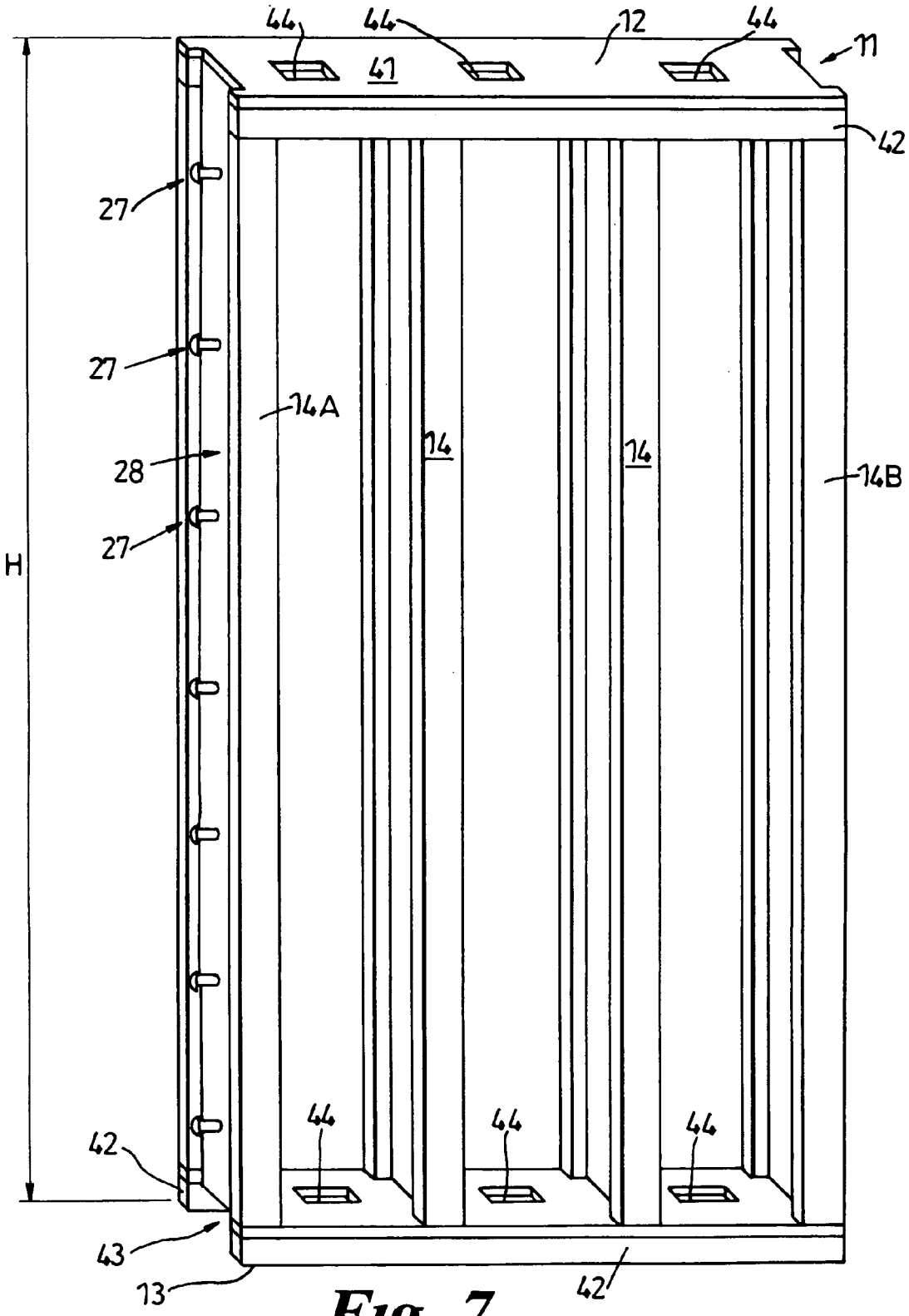
FIG. 7 is an isometric view of the frame of the wall panel with support columns omitted for reasons of clarity.
Figure 8:
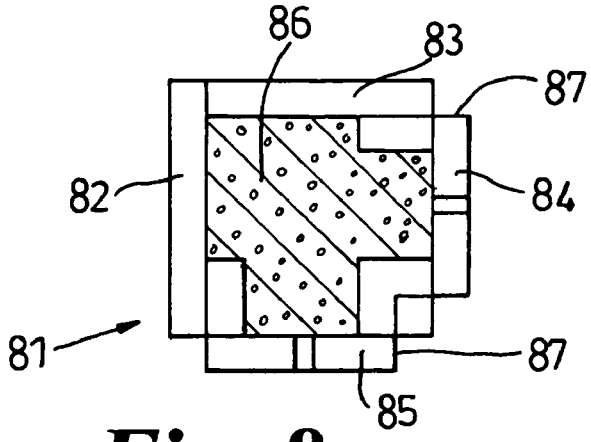
FIG. 8 is a section through a jointing post for linking together adjacent panels.

Each panel 10 has a rectangular frame 11, see FIG. 7 in particular, having top and bottom rails 12,13 interconnected by a plurality of I Beams 14 which form the sides and vertical struts of the frame 11 and are spaced at predetermined distances apart across the width of the panel. A preferred spacing between I beams 14 is 400 mm. Support columns 15 also extend between the top and bottom rails 12 13 and are located centrally between adjacent pairs of I beams 14. The frame 11 is covered on one face, which is use faces externally of the building, with water resistant board 16 and its other face which in use faces inwardly of the building with a second board 17. The externally facing board 16 is preferably 10–12 mm plywood or OSB and the internally facing board may comprise plywood, plasterboard, hardboard, calcium board, magnesia board etc. which may be laminated with a plastic material layer on its exposed face. The laminated layer may be of any suitable plastics material, for example melamine, a PVA coating, etc. and may be provided with a finished decorative surface or may be suitable for painting or wall papering. The boards 16 & 17 are bonded to the beams 14, and the support columns 15, and the internal space between the boards 16 & 17 is filled with thermal insulation 18.

Figure 1:
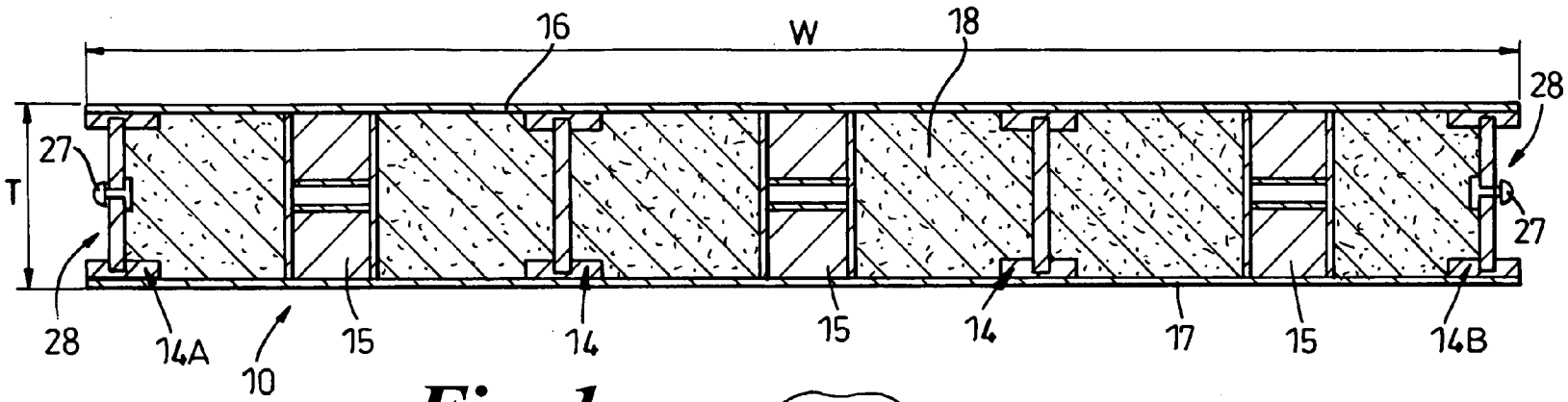
FIG. 1 is a cross section of a wall panel according to the present invention.
Figure 2:
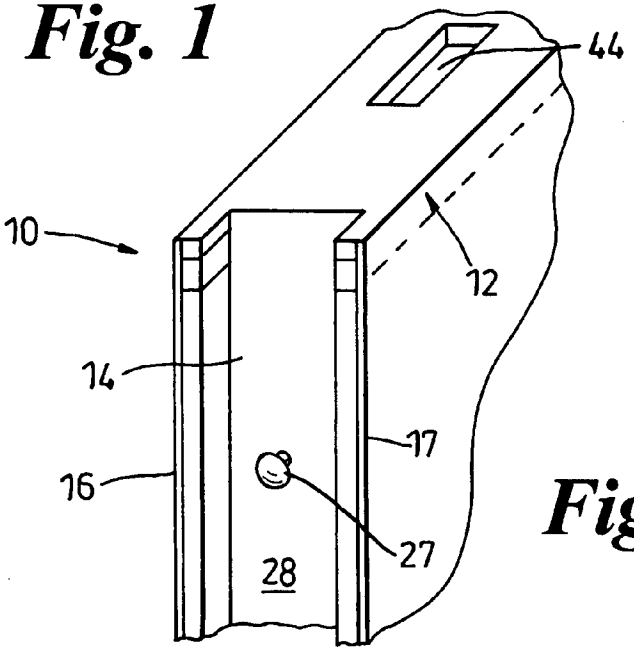
FIG. 2 is an isometric view of a fragment of a wall panel of FIG. 1, FIGS. 3–5 are enlarged sections of components shown in FIG. 1
Figures 3, 4, 5, 6:
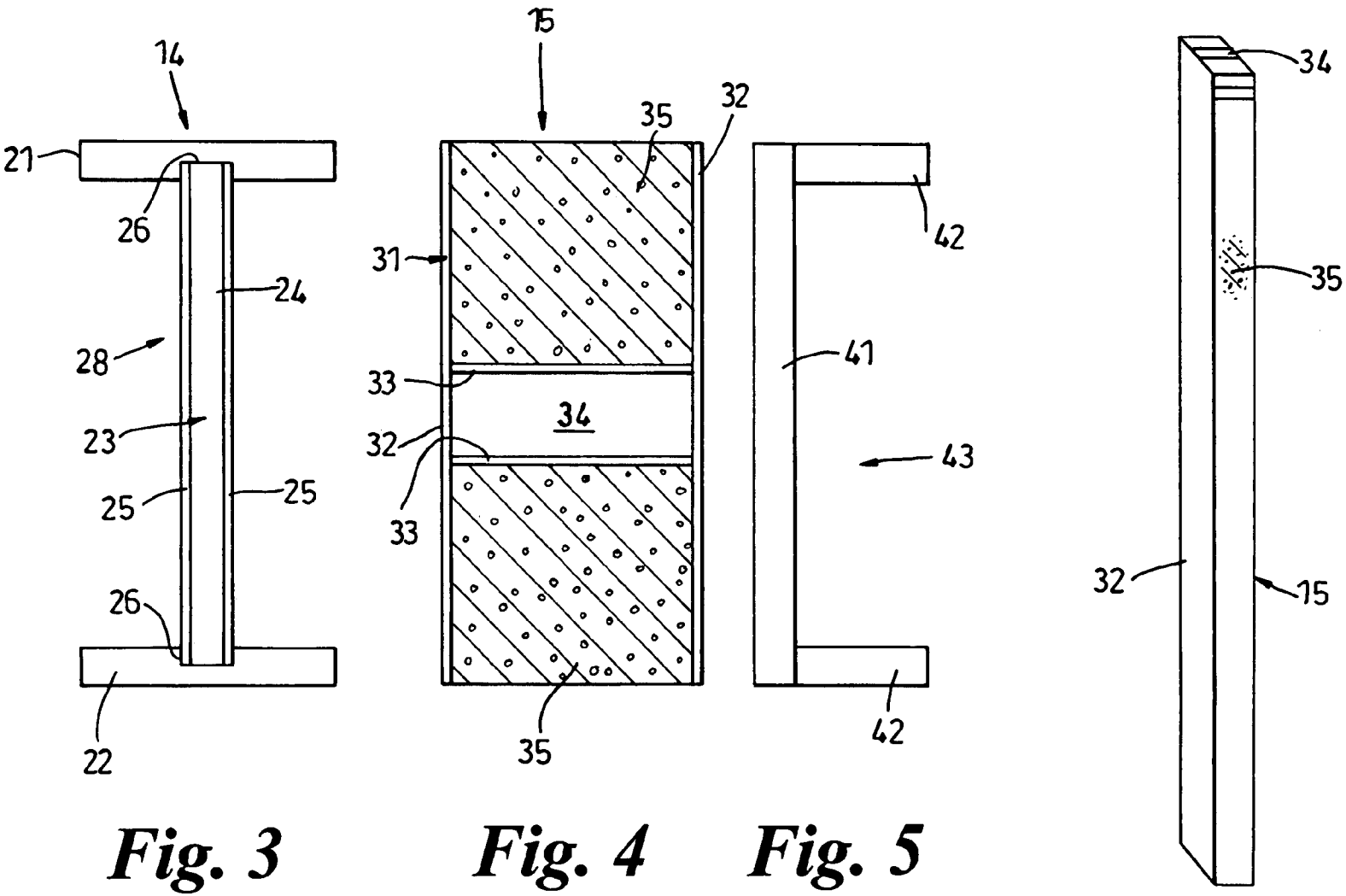
FIG. 6 is an isometric view of a support column used in the wall panel

Referring now particularly to FIG. 3, each I beam is a composite beam having 6–12 mm plywood flanges 21,22 with a central web 23 comprising a rigid cellular layer 24 sandwiched between two thin layer 25 of plywood, hardboard, or card board. The flanges 21,22 are about 50 mm in width having a central groove 26 on their inside surface to accommodate a web 23 of about 10–12 mm in thickness. The recessed longitudinally extending sides of the two I beams 14A, 14B forming the sides of the frame 11 have dowels 27 extending outwardly thereof, and provide a recess 28 used for assembly of adjacent panels.

With particular reference now to FIGS. 4 and 6, there is shown a support column 15 which comprises a "H" section skeleton 31 having planar elongate sides 32 interconnected by a pair of spaced apart elongate cross-members 33 located about the transverse centre of the side members. The sides 32 and cross-members 33 may be formed from 2 mm plywood or other suitable material and form an enclosed cavity 34 in the middle of the column which provides a conduit extending for the length of the column. In use the conduit may accommodate electrical cable, aerial coaxial cable, pipes etc. The outwardly facing cavities in the skeleton 11 are filled with a suitable rigid cellular material, for example a closed-cell foam 35.

With reference now particularly to FIG. 5, the top and bottom rails are substantially identical in cross-section and in this example each comprises a "U" shaped section channel formed from water resistant wood composite, preferably 12 mm plywood. The rails have a flat base 41 with arms 42 extending normally of the base on each side thereof to form an open sided recess 43 between the two arms. Apertures 44 are located in the base 41 for alignment with the conduits 34 formed in the columns 15. The top rail 12 has its base 41 uppermost facing outwardly of the frame 11 to provide an upper surface for the panel 10 and the recess 43 faces inwardly to receive stepped end portions of the I-beams 14 and columns 15. The bottom rail 13 also has its base 41 uppermost with the recess 43 facing downwards and outwardly of the frame 11.

The insulating material 18 may comprise one of Rockwood, dried pulp paper treated with fire-retardant, and fire-retardant foam.

Figure 9:
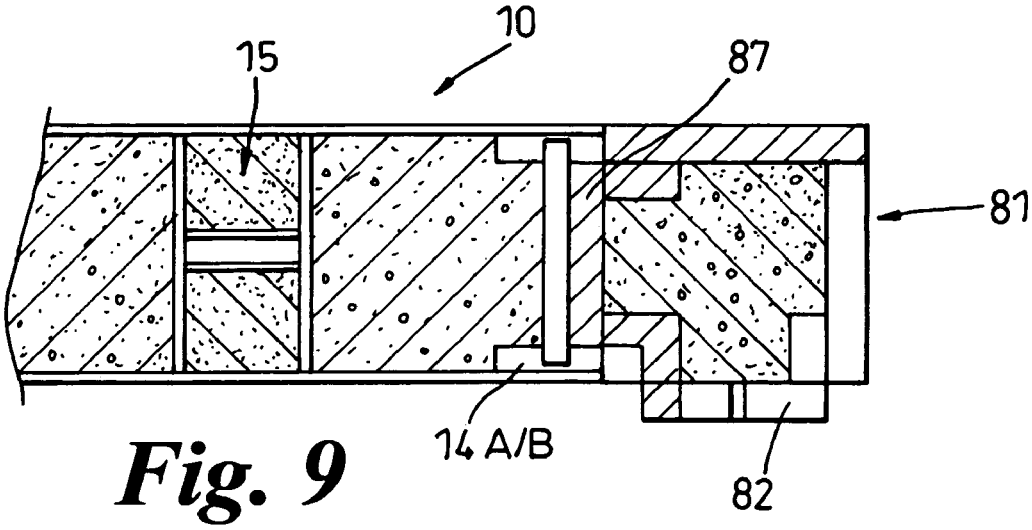
FIG. 9 shows an assembled post and panel
Figure 10:
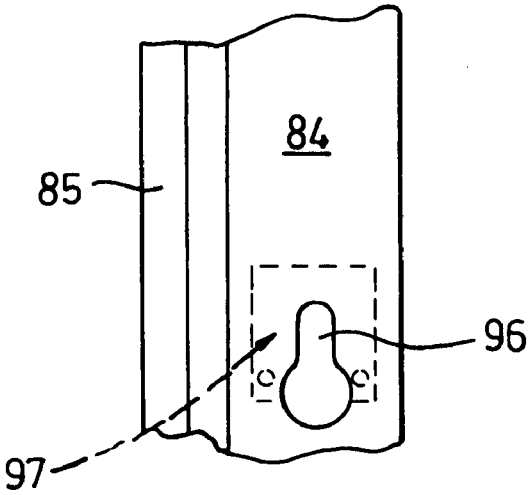
FIG. 10 shows a view of one side of the post.
Figure 11:
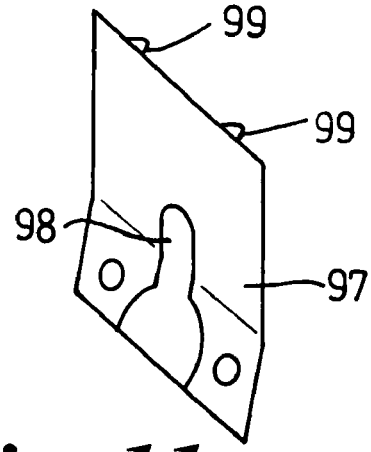
FIG. 11 is an isometric view of an assembly Clip as is used within a jointing post.

With reference now to FIGS. 8–11, adjacent panels are linked together using a jointing post 81 in this example for joining two panels normally of each other to form a corner. The jointing post is box section comprising sidewalls 82–85 formed from plywood with the centre filled with rigid cellular material e.g. a closed cell foam 86. The sides of the post 81 adjacent the panel, in this case sides 84,85, are formed with a projecting tongue 87 located centrally of its respective side and extending longitudinally of the post. As can be seen in FIG. 9 one tongue 87 is accommodated in a recessed side 28 of an I beam 14A or 14B of a panel. It will be appreciated that panels may be located against both tongues. Joining posts may be provided with tongues on one or more sides as is desired and opposite sides of the posts as well as adjacent sides.

Each tongue 87 is provide with a plurality of key-hole shaped apertures 96 which in use accommodate passage of the dowels 27 on the panels 11 (see FIG. 7). On the inner surfaces of the post behind each aperture 96, there is located an assembly clip 97 which is aligned with the aperture 96. The clips 97 co-operate with the dowels 27 to secure wall panels and posts together. Each clip 97 is formed from spring steel and includes a second key hole shaped aperture 98 which engages a respective dowel 27. The lower portion of the clip sits against the inside surface of the post and the upper portion of the clip is inclined away from the inner surface and is provided with abutments 99 to space the end of the lower portion away from the inner surface.

Figure 14:
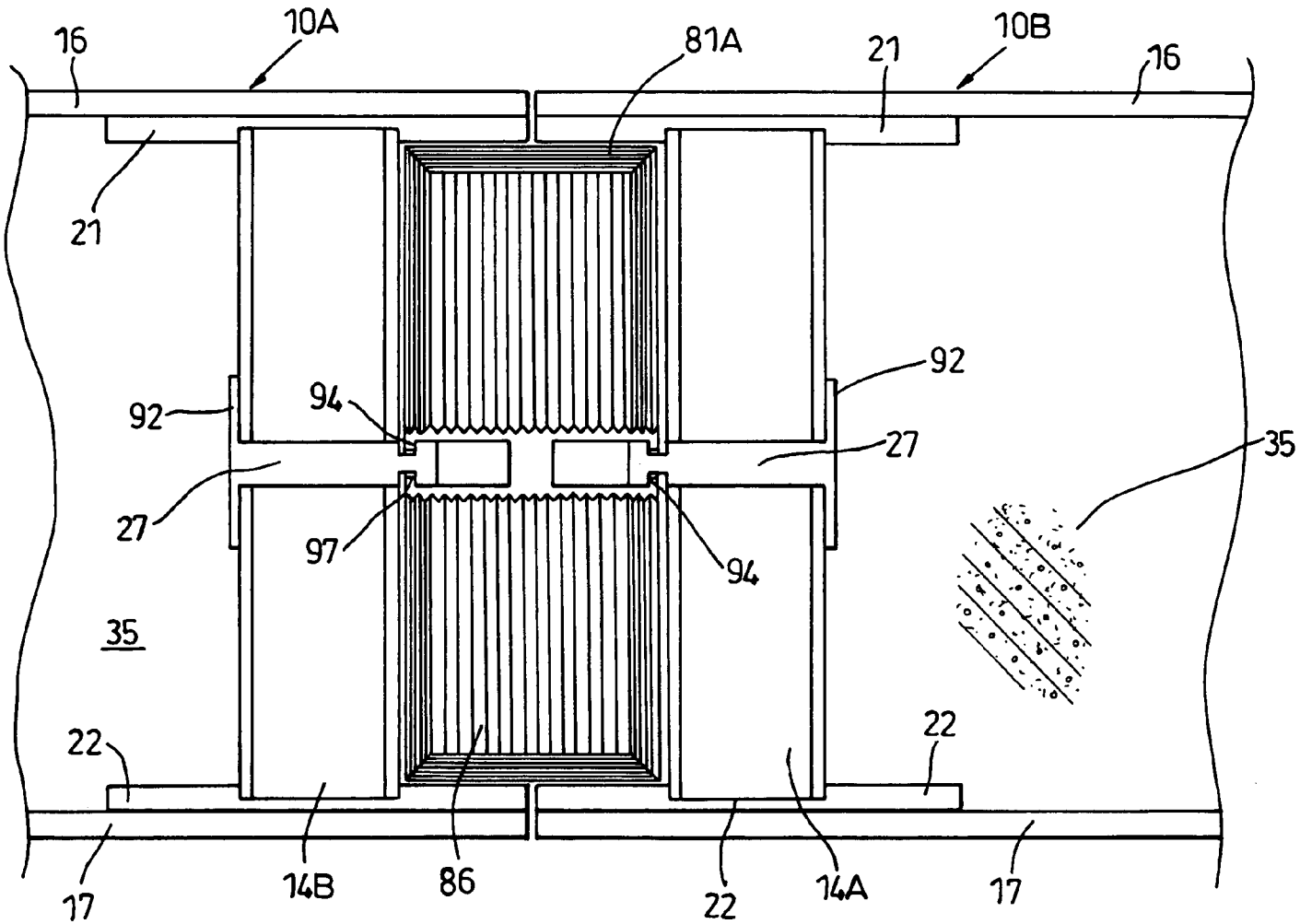
FIG. 14 shows an alternative jointing post.

In an alternative arrangement shown in FIG. 14, in a straight wall or partition, the jointing post 81A between two panels 10A & 10B has a rectangular section with no tongue 87 and is accommodated within the recessed sides 28 of the I beams 14 between the top and bottom flanges 21, 22 thereof.

Figure 12:
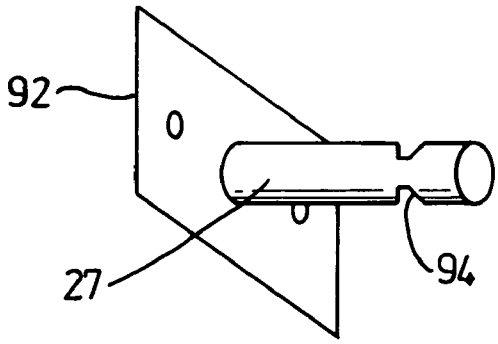
FIG. 12 is a dowel as is used with the clip.

A dowel 27 is shown in FIG. 12 and has a plate 92 for mounting on the inner side of the web 23 of an I beam 14. The dowel 27 has a groove 94 providing a shoulder which co-operates with the key hole aperture 98.

In use a post 81 or 81A may be provided with an alignment lug or mark adjacent the top of the post which locates against the top rail 12 of a panel 10 to align the lower portions of the apertures 98 in the post with each dowel 27 to allow the post 81 to be inserted into a recess 28 of the I beam 15 forming the side of the panel 10. A second or other panel can be assembled in like manner to the other tongue 87 on the post.

Figure 15:
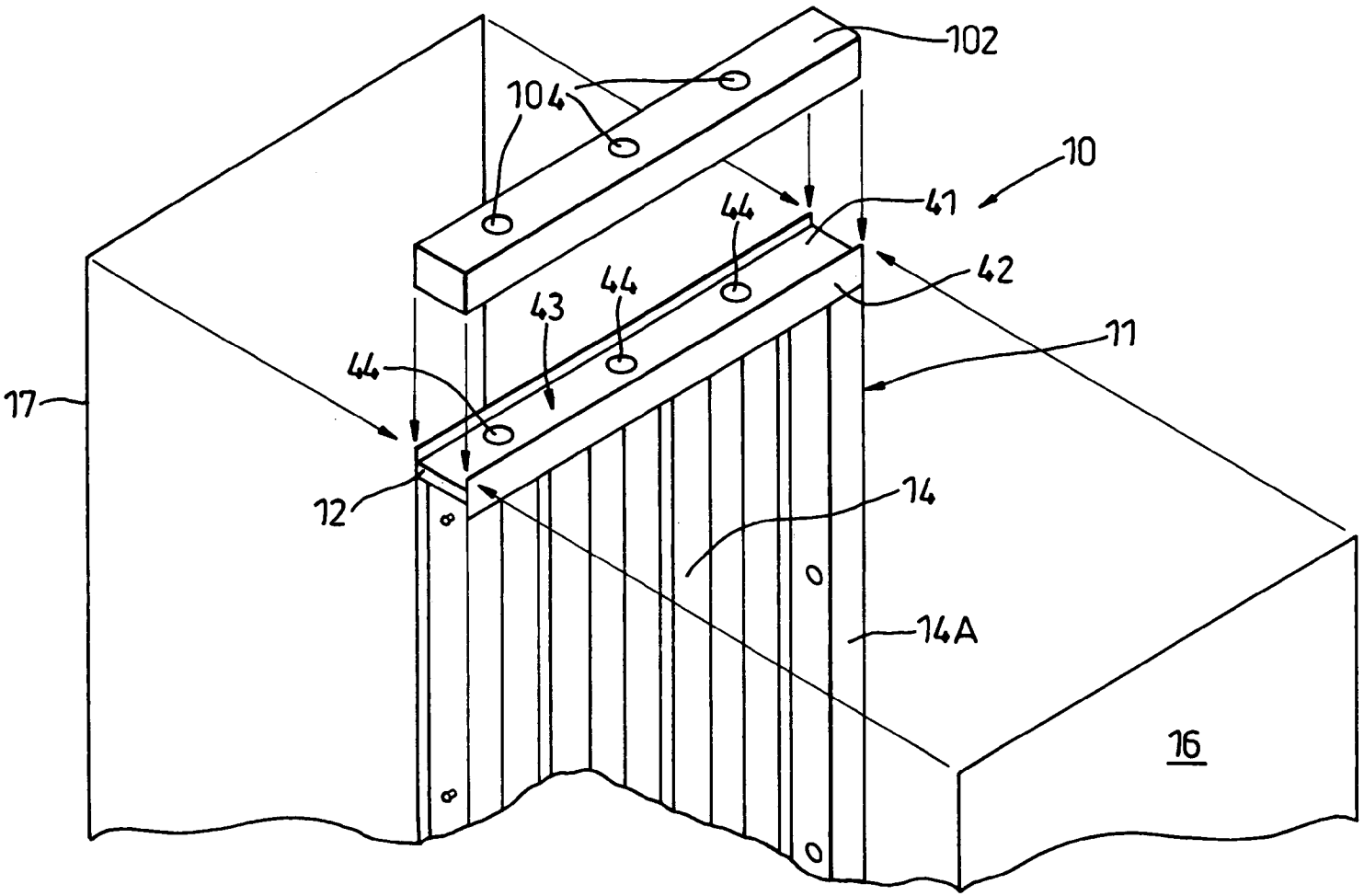
FIG. 15 shows another jointing post.

In an alternative arrangement shown in FIG. 15, the upper portion of the post 81A is provided with a cap 101. The cap 101 is a close fit to the post and is stapled, or otherwise secured to the top surface of the post. The cap 101 holds the post 81A with the larger portions of the respective keyhole apertures 98 in alignment with the dowels on one panel until the post is driven into its operative position.

A second panel is then located over the post.

The post is then driven downwards, removing the cap 101 or other alignment lug, and engaging the shoulders 94 of respective dowels with the narrow part of each respective keyhole 98 in respective clips 97. Since the upper portions of the clips 97 are inclined to the inside of the post this will pull the adjacent panels 10 towards each other and the resilience in the clip locks the panels and post together.

Figure 13:
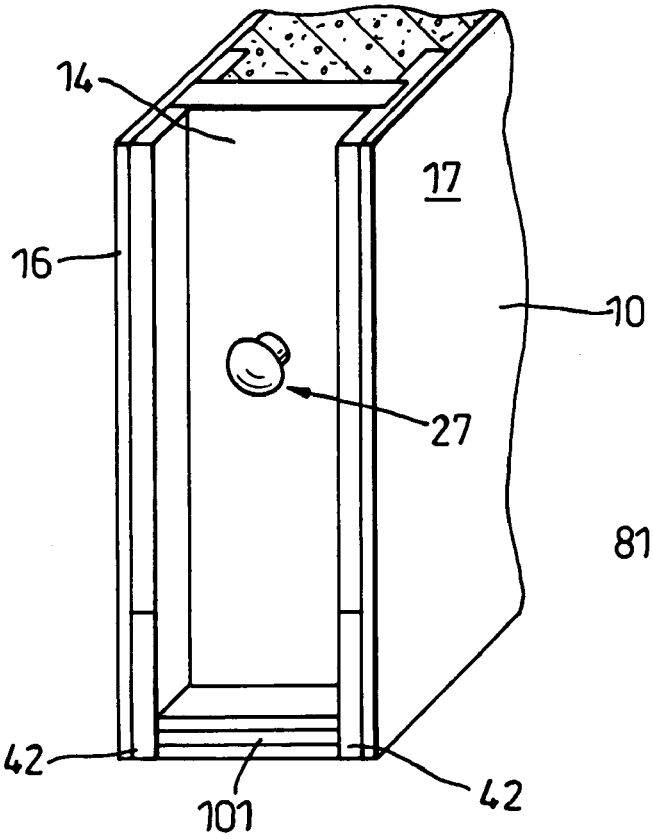
FIG. 13 shows the method of attaching a wall panel to a floor or base.

With reference to FIG. 13, wall panels 10 are mounted to a floor or base by the use of a sole plate 101. The sole plate 101 has a height or thickness slightly in excess of the depth of the recess 43 in the bottom rail 13. The recess 43 within the bottom rail 13 of each panel can slidably locate over the sole plate 101 which has previously been secured to the floor. Nails or other fixings are used to fix the panel 10 to the sole plate.

If desired, wall panels 10 may be placed on top previously assembled walls. A strip 102 (See FIG. 16) similar to the sole plate 101 is utilised and has apertures therein that align with the apertures 44 in top and bottom rails 12 & 13. In this manner, assembled walls may be provided with service conduits within the walls that extend from the top of a house to the bottom.

Figure 16:
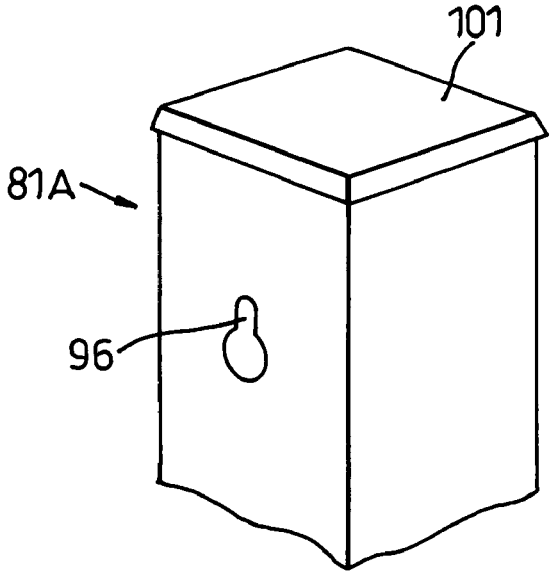
FIG. 16 shows an alternative top rail 12.

In another arrangement shown in FIG. 16 the top rail 12 is a "H" section rail having recesses 43 facing both inwardly (similar to FIG. 7) and outwardly. The strip 102 is located in the recess 43 and protrudes out of the recess 43 to provide a location for the upper panel.

By using wall modules of different widths the vertical joints between adjacent wall panels in one layer of panels may be offset relative to the vertical joints in another layer.

The posts 81 may be provided with inter engaging elements at their top and bottom ends so that the Posts can interlock vertically with each other.

The invention claimed is:

1. A building panel comprising a rectangular frame having two opposing faces covered in board, one of said faces being covered in a water resistant board with a space between the board faces being filled with thermal insulation, the frame having top and bottom rails which are joined together by a plurality of spaced apart wood composite I beams extending therebetween, two of said I beams forming the sides of the frame and have recessed sides facing outwardly of the panel, accommodating in use a rectangular section post for attachment thereto the outwardly facing recessed sides of said two I beams being provided with locking means therein longitudinally spaced along said two I beams for locking a post to said building panel.

2. The building panel as claimed in claim 1 wherein said one face in use faces externally of the building and is made from OSB (oriented strand board).

3. The building panel as claimed in claim 2 wherein the other face of said two faces in use faces internally of the building and comprises board having a plastics material layer on its internal surface.

4. The building panel as claimed in claim 1 wherein the I beams have upper and lower flanges formed from plywood and a web comprising a rigid cellular material sandwiched between two layers of board.

5. The building panel as claimed in claim 1 wherein intermediate support columns extend between the top and bottom rails and are located one column between each pair of adjacent beams, each column comprising a rigid cellular centre having sides formed from a suitable board.

6. The building panel as claimed in claim 5, wherein at least one of said columns has a hollow conduit extending along the middle of the column for its full length, the conduit aligning with apertures formed in either or both the top and bottom rails.

7. The building panel as claimed in claim 6 wherein the hollow conduits are rectangular and are lined on all sides by board.

8. The building panel as claimed in claim 1, wherein the top and bottom rails are U section rails having substantially the same cross section with a flat base with arms extending normally thereof with a recess therebetween, the top rail having the flat base presented outwardly of the panel and the bottom rail having the recess presented outwardly of the panel.

9. The building panel as claimed in claim 1 wherein the locking means comprise shouldered dowels secured to said I beam, the dowels in use for fixing a linking post to a panel.

10. The building as claimed in claim 1 assembled adjacent to similar panels which are linked together by posts having side portions which are engagable within the recessed sides of the I beams.

11. A wall comprising adjacent panels, each panel comprising a rectangular frame having two faces covered in board, one of said faces being covered in a water resistant board, the frame having top and bottom rails which are joined together by a plurality of spaced apart wood composite I beams extending therebetween, two of said I beams forming the sides of the frame and having recessed sides facing outwardly of the panel, with the space between the boards being filled with thermal insulation, wherein the recessed sides of said two I beams are provided with shouldered dowels longitudinally spaced along said I beams and secured thereto, the dowels in use for fixing a linking post to panel, said adjacent panels being linked together by posts accommodated within the recessed sides of the I beams, the post having a box section that comprising plywood sidewalls and central cavity filled with a rigid cellular material.

12. A wall as claimed in claim 11 wherein the sides of the posts are be provided with key hole apertures which are engagable with shouldered dowels secured to the I-beams for fixing the post to a panel.

13. A wall as claimed in claim 12 characterised in that clips are located within each post in alignment with each key hole aperture.

14. A wall as claimed in claim 13 characterised in that each clip is formed in resilient material with a portion inclined internally of the post and has a second key hole aperture therein so that when a dowel engages in a key-hole, longitudinal displacement of the post will tend to pull the post and respective panel together.

15. A wall as claimed in claim 13 characterised in that each post is provided with an alignment mark at its upper end to both align and orientate the key-hole clips on the post with respect to the dowels on the panel.

16. An internal wall or portion for a building comprises adjacent building panels, each panel comprising a rectangular frame having two faces covered in board, one of said faces being covered in a water resistant board, the frame having top and bottom rails which are joined together by a plurality of spaced apart wood composite I beams extending therebetween, two of said I beams forming the sides of the frame and having recessed sides facing outwardly of the panel, with the space between the board faces being filled with thermal insulation, adjacent panels being linked together by posts having side portions which are engagable within the recessed sides of the I beams, the posts being formed with longitudinal tongues which are a slide fit within the recessed sides of the I beams, and the outwardly facing recessed sides of said two I beams being provided with locking means therein longitudinally spaced along said I beams for locking the posts to the panels.

* * * * *